United States Patent [19]

Singhal et al.

[11] Patent Number: 5,064,527

[45] Date of Patent: Nov. 12, 1991

[54] CATALYTIC PROCESS FOR HYDROCONVERSION OF CARBONACEOUS MATERIALS

[75] Inventors: Gopal H. Singhal, Houston; Bobby L. Wilson, Missouri City; Edward H. Edelson, Seabrook, all of Tex.; Michael A. Mikita, Englewood, Colo.

[73] Assignee: Exxon Research & Engineering Company, Florham Park, N.J.

[21] Appl. No.: 608,308

[22] Filed: May 8, 1984

[51] Int. Cl.[5] ..... C10G 1/06; C10G 1/08

[52] U.S. Cl. ..... 208/420; 208/112; 208/421; 208/422; 208/423; 502/220

[58] Field of Search ..... 208/10, 108, 112, 143, 208/420, 112 L, 421, 422, 423; 201/2.5; 585/240; 502/220

[56] References Cited

U.S. PATENT DOCUMENTS

| | | | |
|---|---|---|---|
| 3,161,584 | 12/1964 | Gleim | 208/264 |
| 3,236,762 | 2/1966 | Robo et al. | 208/120 X |
| 3,252,895 | 5/1966 | Gleim et al. | 208/264 |
| 4,090,943 | 5/1978 | Moll et al. | 208/10 |
| 4,102,775 | 7/1978 | Quarderer et al. | 208/10 |
| 4,192,735 | 3/1980 | Aldridge et al. | 208/112 |
| 4,243,554 | 1/1981 | Naumann et al. | 502/220 |
| 4,244,839 | 1/1981 | Aldridge et al. | 252/431 C |
| 4,369,106 | 1/1983 | Aldridge et al. | 208/10 |
| 4,389,301 | 6/1983 | Dahlberg et al. | 208/59 |
| 4,399,024 | 8/1983 | Fuki et al. | 208/131 |
| 4,457,835 | 7/1984 | Kukes | 208/251 H |
| 4,528,089 | 7/1985 | Pecoraro et al. | 208/254 H |
| 4,540,481 | 9/1985 | Sawyer et al. | 208/254 H |
| 4,544,481 | 10/1985 | Seiver et al. | 208/254 H |
| 4,560,468 | 12/1985 | Kukes et al. | 208/112 L |
| 4,561,964 | 12/1985 | Singhal et al. | 208/112 L |
| 4,564,441 | 1/1986 | Kukes et al. | 208/112 |
| 4,578,179 | 3/1986 | Kukes et al. | 208/111 |
| 4,581,125 | 4/1986 | Stiefel et al. | 208/254 H |
| 4,612,110 | 9/1986 | Kukes et al. | 208/112 |

FOREIGN PATENT DOCUMENTS

| | | |
|---|---|---|
| 80379 | 8/1983 | Japan . |
| 180586 | 10/1983 | Japan . |

*Primary Examiner*—Gary P. Straub

*Attorney, Agent, or Firm*—Wayne Hoover; Penny L. Prater

[57] ABSTRACT

An improved hydroconversion process for carbonaceous materials wherein a dihydrocarbyl substituted dithiocarbamate of a metal selected from any one of Groups IV-B, V-A, VI-A, VII-B, and VIII-A of the Periodic Table of Elements or a mixture thereof is used as a catalyst precursor. The improved process is effective for both normally solid and normally liquid carbonaceous materials and for carbonaceous materials which are either solid or liquid at the conversion conditions. The hydroconversion will be accomplished at a temperature within the range from about 500° to about 900° F., at a total pressure within the range from about 500 to 7000 psig and at a hydrogen partial pressure within the range from about 400 to about 5000 psig.

22 Claims, 1 Drawing Sheet

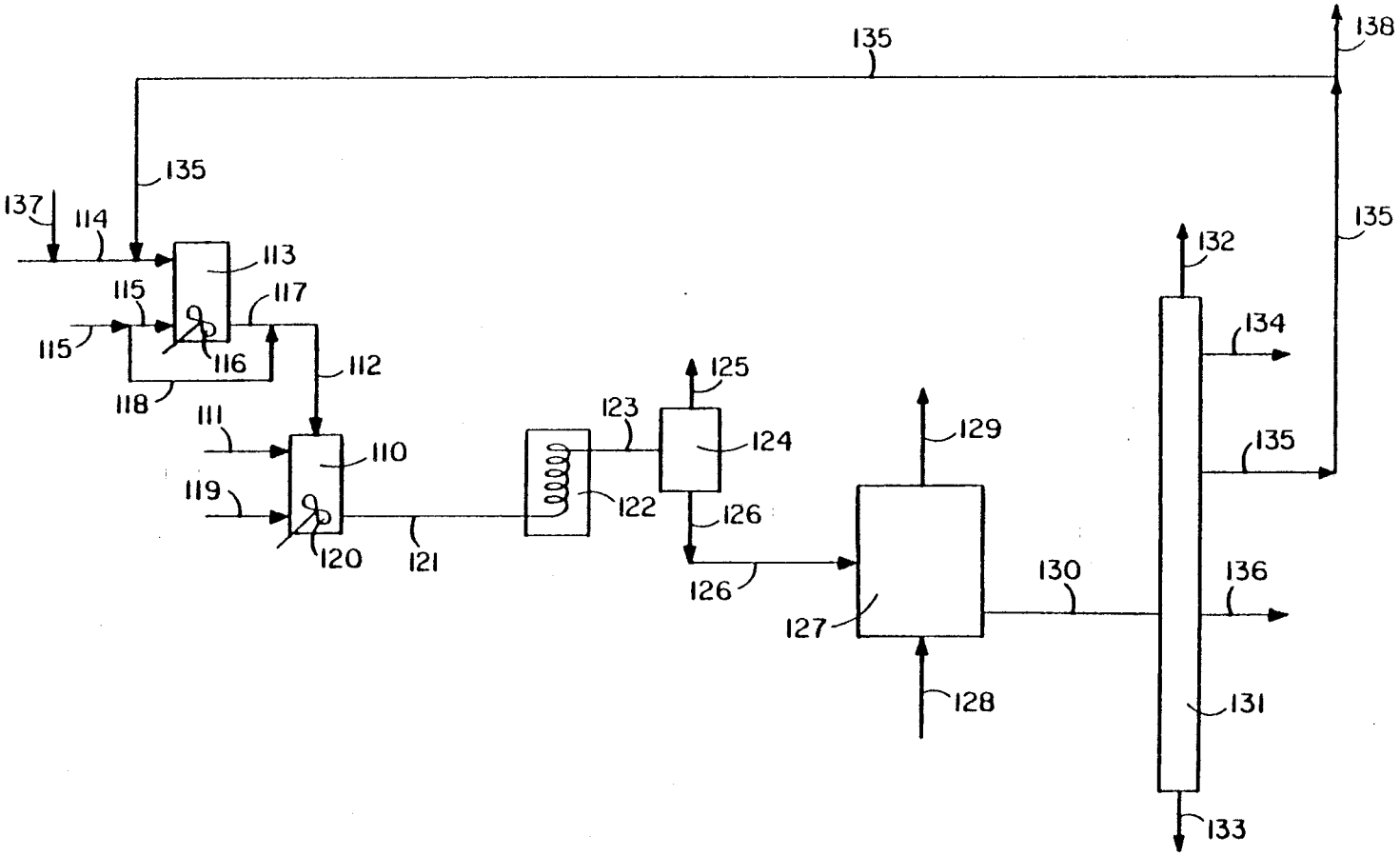
138
135
135
134
135
136
131
132
133
130
129
128
127
135
124
125
126
126
123
122
121
110
120
112
113
117
116
111
119
135
115
118
114
115
137

CATALYTIC PROCESS FOR HYDROCONVERSION OF CARBONACEOUS MATERIALS

BACKGROUND OF THE INVENTION

This invention relates to an improved process for hydroconverting carbonaceous materials to lower molecular weight products. More particularly, this invention relates to the improved catalytic process for hydroconverting carbonaceous materials to lower molecular weight products.

Heretofore, several catalytic processes for hydroconverting solid carbonaceous materials such as coal, lignite, peat and the like to lower molecular weight products and for converting heavier petroleum fractions such as atmospheric and vacuum residuals to lower molecular weight products have been proposed. The lower molecular weight products may be gaseous or liquid or a mixture of both. In general, the production of lower molecular weight liquid products is particularly desirable since liquid products are more readily stored and transported and, often, are conveniently used as motor fuels.

Heretofore, a large number of suitable catalysts have been identified as useful in such hydroconversion processes. For example, metal sulfides and oxides and mixtures thereof have been particularly useful as catalysts in such processes. Moreover, a host of catalyst precursors; that is, compounds that will either decompose or are readily converted to an active sulfide or oxide form have been identified. Such precursors include metal complexes such as transition metal naphthenates and phospho-transition metal acids and inorganic compounds such as ammonium salts of transition metals. In general, the precursors used have either been soluble, to some extent, in the reaction medium itself or in a solvent which is added to the reaction medium. The solvents heretofore employed have been both organic and inorganic.

As is well known in the prior art, the effectiveness of the transition metal sulfide and oxide catalysts has been limited by the respective solubilities of the precursors at atmospheric conditions or upon heating in the reaction media itself or in the solvent used to incorporate the same into the reaction media. While the reason or reasons for this limitation on catalytic activity is not well known, it is believed to be due either to the particle size of the active catalyst species ultimately formed in the reaction media or as a result of poor distribution of the active catalyst species within the reaction mixture. Moreover, most, if not all, of the precursor species proposed heretofore require a treatment of some kind with a sulfur compound before the more active sulfide catalyst species is ultimately obtained. Since the catalytic processes heretofore proposed have experienced effectiveness limitations due either to the formation of relatively large particle size catalyst species or as a result of poor distribution of the catalyst species within the reaction media and since most, if not all, require some treatment with a sulfur compound, the need for an improved catalytic process wherein the catalytic activity is improved either as a result of reduced particle size or improved distribution and wherein a special treatment with a sulfur compound is not required is believed to be readily apparent.

SUMMARY OF THE INVENTION

It has now been discovered that the foregoing and other disadvantages of the prior art catalytic processes can be avoided, or at least reduced, with the method of the present invention and an improved process for converting carbonaceous materials to lower molecular weight products provided thereby. It is, therefore, an object of this invention to provide an improved catalytic process for the conversion of carbonaceous materials to lower molecular weight products. It is another object of this invention to provide such a catalytic process wherein the active catalyst species or species formed is either relatively small or at least is more uniformly distributed thereby yielding increased conversions. It is still a further object of this invention to provide such a catalytic process wherein a treatment with a sulfur compound is not needed. The foregoing and other objects and advantages will become apparent from the description set forth hereinafter and from the drawings appended thereto.

In accordance with the present invention, the foregoing and other objects and advantages are accomplished by converting a carbonaceous material to lower molecular weight products in the presence of a metal sulfide or a mixture of such sulfides of a metal from any one of Groups VI-A and VIII-A of the Periodic Table of Elements formed either prior to or during the conversion process through the decomposition of a metal dihydrocarbyl substituted dithiocarbamate or from a mixture of such dithiocarbamate and in the presence of molecular hydrogen at an elevated temperature and pressure. As pointed out more fully hereinafter, the total conversion of the carbonaceous material to lower molecular weight products can be increased or decreased to some extent by controlling the temperature at which the active catalyst species is formed. As indicated more fully hereinafter, the various precursors useful in this invention have varying decomposition temperatures and this temperature is controlled simply by selecting a particular precursor or mixtures thereof for use.

BRIEF DESCRIPTION OF THE DRAWING

The FIGURE is a schematic flow diagram of a process within the scope of the present invention.

DETAILED DESCRIPTION OF THE INVENTION

As indicated, supra, the present invention relates to an improved catalytic process for converting carbonaceous materials to lower molecular weight products wherein a dihydrocarbyl substituted dithiocarbamate of a metal selected from any one of Groups VIA, and VIII-A of the Periodic Table of Elements or a mixture of such compounds is used as a catalyst precursor (which compounds shall hereinafter be referred to generically as dihydrocarbyl substituted dithiocarbamates of a metal). As also indicated, supra, the conversion of the carbonaceous material will take place in the presence of molecular hydrogen at an elevated temperature and pressure. As indicated previously and as will be described more fully hereinafter, the relative activity of the metal sulfide or mixtures thereof formed from the precursor can be increased or decreased by varying the temperature at which the precursor or precursors are converted to an active catalyst form.

In general, the method of the present invention can be used to convert any non-gaseous carbonaceous material to lower molecular weight products. The carbonaceous material may then be either normally solid or normally liquid and may be either solid or liquid at conversion conditions. Suitable normally solid carbonaceous materials include, but are not necessarily limited to coal, trash, biomass, tar and bitumen and the like. This invention is particularly useful in the catalytic liquefaction of coal and may be used to liquefy any of the coals known in the prior art including bituminous coal, subbituminous coal, lignite, peat, brown coal and the like. These materials are, at least initially, solid at conversion conditions. Suitable carbonaceous materials which may be normally liquid, include, but are not necessarily limited to, materials remaining after a crude oil has been processed to separate lower boiling constituents, such as petroleum residuals. In general, petroleum residuals will have an initial boiling point within the range from about 650° F. to about 1050° F. The petroleum residuals will, in all cases, be liquid at the conditions used to effect the catalytic conversion in the improved process of this invention. The improved process of this invention is also particularly applicable to the conversion of bottoms from a vacuum distillation column having an initial boiling point within the range of from about 850° F. to about 1050° F.

In general, and when a carbonaceous material, which is solid at the conversion conditions, is converted in the improved process of this invention, the same will be ground to a finely divided state. The particular particle size or particle size range actually employed, however, is not critical to the invention and, indeed, essentially any particle size can be employed. Notwithstanding this, generally, the solid carbonaceous material which may be liquefied in accordance with this invention, will be ground to a particle size of less then ¼ inch and preferably to a particle size of less than about 8 mesh (M.B.S. sieve size). In the improved process of the present invention and when a petroleum residual is converted, the petroleum residual may be combined with a solvent or diluent but the use of a solvent is not critical or essential and, indeed, the catalyst may be added directly to the petroleum residual. When this is done, however, it may be necessary to heat and stir the petroleum residual to insure good dispersion of the catalyst precursor in the petroleum residual.

The catalyst precursors useful in the improved process of the present invention are dihydrocarbyl substituted dithiocarbamates of metals having the general formula:

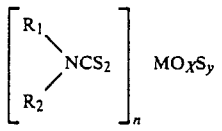

1.

Wherein:

$R_1$ and $R_2$ are the same or a different $C_1$–$C_{18}$ alkyl radical; a $C_5$–$C_8$ cycloalkyl radical or a $C_6$–$C_{18}$ alkyl substituted cycloalkyl radical; or an aromatic or alkyl substituted aromatic radical containing 6 to 18 carbon atoms, it being understood that $R_1$ and $R_2$ may separately be any one of these hydrocarbyl radicals; and M is a metal selected from Groups IV-B, V-A, VI-A, VII-A and VIII-A of the Periodic Table of Elements as copyrighted by Sargent-Welch Scientific Company, 1979, or a hydrocarbo substituted metal from any one of the same groups, And wherein:

For divalent elements X=Y=0, n=2; 1 and

For trivalent elements X=Y=0, n=3; and

For tetravalent, pentavalent and hexavalent elements X=0–2 and Y=2–0 within the provision that when X=2, Y=0; when X-1, Y can be 0 or 1. In all these cases, the valence of metal will be between 4 and 6.

The precursors useful in the improved process of the present invention are oil soluble at least in the concentrations used in the present process at the conditions employed for combining the catalyst with a carbonaceous material and are thermally decomposible to the corresponding metal sulfide at conditions milder than those used to effect the hydroconversion of the carbonaceous material. Since each of these compounds contain at least enough sulfur to form the corresponding sulfide and since this is the normal conversion product of the precursor at the conditions used for forming the active catalyst and/or the conditions used during the conversion of the carbonaceous material, a separate sulfur treatment is not necessary or essential to the formation of the catalytically active sulfide species.

Many of the hydrocarbyl substituted metal dithiocarbamates useful as catalyst precursors in the process of the present invention are available commercially in the United States. Moreover, all can be prepared by any of the standard methods known in the prior art. One such standard method is as follows:

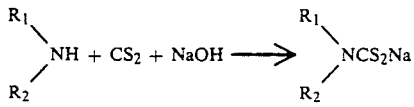

2.

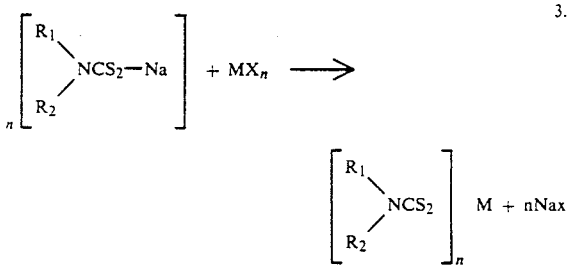

3.

Wherein:

$R_1$ and $R_2$ may be the same or a different hydrocarbyl radical as identified in equation 1 above; and M is a metal as identified in equation 1 above; and X is $Cl^-$, $Br^-$, $I^-$, $NO_3^-$, $CH_3CO_2^-$, $SO_4^=$, etc.

In general, the catalyst will be added to or combined with the carbonaceous material at a concentration within the range from about 10 ppm to about 10,000 ppm, by weight, metal based on dry, ash-free (DAF) carbonaceous material. The catalyst precursor may be added to the solvent and then combined with a carbonaceous material when a solvent is employed or the catalyst may be added or combined with the carbonaceous material and then the solvent. When a solvent is not used, particularly with a petroleum residual, the catalyst precursor will be combined directly with the petroleum resid.

After the catalyst precursor or a mixture thereof has been combined with the carbonaceous material, the same will be converted to an active catalyst- species and particularly to the corresponding sulfide or mixture of sulfides by heating the combination of carbonaceous material and catalyst precursor or precursors either in the presence or absence of the sol-vent to a temperature at which the hydrocarbyl substituted dithiocarbamate is converted to the corresponding sulfide as a result of the sulfur already contained in the dithiocarbamate. While the actual temperature or temperatures at which the conversion from dithiocarbamate to sulfide occurs will vary depending upon the metal ion and the hydrocarbyl radical or radicals contained in the dithiocarbamate, the conversion will, generally, occur at a temperature equal to or above 150° F. and below about 625° F. While the inventors do not wish to be bound by any particular theory, it is believed that the relative catalytic activity and the resulting product distribution may be varied by varying the hydrocarbyl radical or radicals and the metal ion or ions contained in the precursor, thereby varying the temperature at which the dithiocarbamate is converted to the corresponding sulfide. In this regard, it should be noted that precursors having lower decomposition temperatures tend to lead to the formation of catalytically active species which are more active (or more uniformly distributed in the reaction media) than do precursors having higher decomposition temperatures.

While a separate conversion step of the precursor to an active catalyst form is contemplated in the improved process of the present invention, such a separate treatment is not necessary, especially when product distributions and overall conversions resulting from conversion of the precursor at the same or a lower temperature (as may occur during heat-up to the conversation temperature) as that used during the carbonaceous material conversion is acceptable. Moreover, and when a separate co-version step is employed, the precursor will, generally, be decomposed to the corresponding sulfide in an inert atmosphere and in the absence of hydrogen.

After the mixture of catalyst precursor and carbonaceous material has been prepared, either with or without a solvent, and the precursor converted to an active catalyst form, when a separate decomposition step is used or during heat-up of the mixture when a separate decomposition step is not used, the mixture will be passed to a carbonaceous material conversion zone and at least a portion of the carbonaceous material will be converted to lower molecular weight products in the presence of hydrogen. In general, the conversion will be accomplished at a temperature within the range from about 500° F. to about 1000° F. and at a total pressure within the range from about 500 psig to about 7000 psig. Molecular hydrogen will be present during the conversion at a partial pressure within the range from about 400 to about 5000 psig. In general, the conversion of the carbonaceous material may be accomplished either in a single stage or in a plurality of stages. In any case, the total nominal holding time at conversion conditions will, generally, range from about 10 minutes to about 600 minutes. Moreover, and while significant conversions will be realized when catalyst concentration is maintained within the aforementioned range (10 ppm to 10,000 ppm, by weight metal based on carbonaceous feed material, DAF) on a once-through basis, the catalyst concentration, and hence, catalytic activity in any stage or stages can be increased by recycling bottoms material containing active catalyst species to said stage or stages.

In general, the conversion of the carbonaceous material to lower molecular weight products results in the production of a normally gaseous product, a normally liquid product and a bottoms product which will have characteristics similar to or identical to those of the feed material. In this regard, it should be noted that when the carbonaceous material is a normally solid material, the bottoms product will be normally solid. When a carbonaceous material is a petroleum resid, on the other hand, the bottoms product may be just a high boiling liquid product. As used herein, the recitation "normally" means at atmospheric conditions. After the conversion of the carbonaceous material is completed, the several products may be separated into their respective phases using conventional techniques. The catalyst, in some form, will, generally, be contained in the bottoms product.

In general, and when a plurality of conversion stages or zones are employed, the gaseous and lighter boiling liquid hydrocarbons will, generally, be separated between each stage. Normally, this separation will include all components having a boiling point below about 350° to about 450° F. Moreover, after the lower boiling point materials have been separated, a portion of the remaining slurry could be recycled to any previous stage to increase the total conversion and the catalyst concentration in said zone. When a single conversion stage or zone is employed or after the final stage when a plurality of conversion stages or zones is used, the product from the conversion will be separated into at least three product streams. Moreover, in those operations wherein a solvent is used, this solvent will be separated from the normally liquid product. In this regard, it should be noted that when the carbonaceous material is a solid and particularly coal, lignite, peat or the like, the solvent fraction will, preferably, have an initial boiling point within the range from about 350° to about 650° F. and a final boiling point within the range from about 700° to about 1100° F. When a solvent is used with a petroleum residual, on the other hand, a heavier solvent will, generally, be used and this solvent will, preferably, have an initial boiling point within the range from about 650° F. to about 800° F. and a final boiling point within the range from about 800° F. to about 1100° F.

As indicated previously, the metal constituents of the dithiocarbamate precursor will be selected from the group consisting of Groups VIA and VIII-A of the Period Table of Elements, copyrighted by Sargent-Welch Scientific Company, and mixtures thereof, said group including tantalum, chromium, molybdenum, tungsten, manganese, rhenium, iron, cobalt, nickel and the noble metals including platinum, iridium, palladium, osmium, ruthenium, and rhodium. The preferred metal constituent in the catalyst precursors useful in the present invention will be selected from Group VI-A of the Periodic Table; viz., molybdenum, and tungsten. Most preferably, the metal constituent will be either molbydenum or chromium.

After the carbonaceous material conversion is completed, the gaseous product may be upgraded to a pipeline gas or the same may be burned to provide energy for the conversion process. Alternatively, all or any portion of the gaseous product may be reformed to provide hydrogen for the liquefaction process.

The liquid product may be fractionated into essentially any desired product distribution and/or a portion thereof may also be used directly as a fuel or upgraded using conventional techniques. Generally, a naphtha boiling range fraction will be recovered and the naphtha fraction will be further processed to yield a high quality motor gasoline or similar fuel boiling in the naphtha range. Also, a middle distillate fraction may be separated from the liquid product and upgraded for use as a fuel oil or as a diesel oil.

The bottoms product may be gasified, depending upon its carbon content, to produce hydrogen for the conversion process or burned to provide heat or the conversion process. In the case of relatively high conversion, however, and when the carbon content is too low to make either gasification or combustion feasible, the bottoms product may simply be disposed of as a waste material. In this case, all or a portion of the catalyst may be recovered in either an active or inactive form.

PREFERRED EMBODIMENT

In a preferred embodiment of the improved process of the present invention, an alkyl substituted dithiocarbamate of a transition metal, wherein $R_1$ and $R_2$ in Formula 1, supra, will be the same or a different alkyl group containing from 1 to 10 carbon atoms will be used. In a most preferred embodiment of the improved process of the present invention, the transition metal will be molybdenum. Also, in a preferred embodiment, the transition metal dithiocarbamate will be converted to the corresponding metal sulfide during heat-up of the precursor to the conditions employed in the carbonaceous material conversion stage or zone. Still in a preferred embodiment of the improved process of the present invention, the carbonaceous material will be converted at an average conversion temperature within the range from about 700° to about 870° F., most preferably 750° to 860° F., in the presence of molecular hydrogen at a partial pressure within the range from about 1000 to about 1800 psig, most preferably 1200 to 1600 psig, and at a total pressure within the range from about 800 to about 3000 psig, most preferably 1500 to 2500 psig.

While the improved process of the present invention may be practiced in either a batch or continuous operation and with either a single conversion zone or with a plurality of conversion zones, the improved process of this invention will, preferably, be practiced continuously in a single stage operation. Moreover, in a preferred embodiment of the present invention, a solvent will be employed and the catalyst precursor will be combined with the solvent prior to combining the solvent with the carbonaceous material. In a preferred embodiment, the catalyst concentration will be within the range from about 50 to about 2000 ppm of metal on a weight basis, based on dry, ash-free carbonaceous material and, in a most preferred embodiment, the catalyst concentration will be within the range from about 100 to about 1000 ppm of metal on a weight basis, based on dry, ash-free carbonaceous material. In a most preferred embodiment of the present invention, the hydrocarbyl substituted dithiocarbamate of a transition metal will be used to convert a solid carbonaceous material, particularly coal, lignite, peat and the like.

A single stage embodiment of the present invention is illustrated in the attached FIGURE and it is believed that the invention will be better understood by reference to this FIGURE. Referring then to the FIGURE, a carbonaceous material is introduced into preparation vessel 110 through line 111. As indicated, supra, the carbonaceous material may be either normally solid or normally liquid. When the carbonaceous material is solid at the conditions at which it is introduced into preparation vessel 110, the carbonaceous material will be finely divided. In the preparation vessel, the carbonaceous material is combined with a dihydrocarbyl substituted dithiocarbamate of a metal, which, as indicated previously, serves as a catalyst precursor, which catalyst precursor is introduced through line 112. In a preferred embodiment, and when the catalyst precursor has been previously combined with a solvent or diluent, the precursor-solvent may be combined in a suitable mixing vessel such as 113. In the embodiment illustrated, a suitable solvent may be introduced into mixing vessel 113 through line 114 while the catalyst precursor is introduced into mixing vessel 113 through line 115. Generally, agitating means such as agitator 116 will be provided in mixing vessel 113. The mixing vessel may be operated at any suitable temperature to insure that the catalyst precursor is dissolved in the solvent as the mixture is withdrawn through line 117 and passed into line 112. When a solvent is not employed or when the catalyst precursor and solvent are not premixed, the precursor may be fed directly into line 112 from line 115 through line 118. In those embodiments wherein a solvent is used but not combined with a catalyst precursor prior to introduction into preparation vessel 110, a suitable solvent may be introduced through line 119. To insure the preparation of a relatively uniform mixture of carbonaceous material, catalyst precursor (and solvent, when a solvent is employed) preparation vessel 110 may comprise suitable agitation means such as agitator 120. Generally, the preparation vessel 110 will be operated at conditions suitable for the preparation of a satisfactory mixture and, in any case, at a temperature sufficient to insure that the catalyst precursor remains dissolved in the solvent or, when a solvent is not employed, in the carbonaceous material. After the mixture of carbonaceous material, catalyst precursor (and solvent, when a solvent is employed) is prepared, the same will be withdrawn from the preparation vessel through line 121. The mixture will then be heated to a temperature at or near conversion temperature by passing the same through preheater 122. The mixture is then withdrawn through line 123 and, when a carbonaceous material containing water has been used, the mixture may be passed to flash drum 124 wherein at least a portion of water, as steam, may be flashed overhead through line 125 and a mixture suitable for conversion withdrawn through line 126. The mixture is then fed to conversion stage or zone 127 and is combined with molecular hydrogen added through line 128.

In the conversion zone 127, the carbonaceous material will be converted, at least in part, to lighter molecular weight products. The conversion will, generally, be achieved at a temperature within the range from about 500° to about 900° F. and at a total pressure within the range from about 500 to about 7000 psig and with a hydrogen partial pressure within the range from about 400 to about 5000 psig. In a preferred embodiment, the conversion will be achieved at a temperature within the range from within about 700° to about 870° F. at a total pressure within the range from about 800 to about 3000 psig and at a hydrogen partial pressure within the range from about 1000 to about 1800 psig. In a most preferred embodiment of the present invention, the conversion will be accomplished at a temperature within the range from about 750° F. to about 860° F. at a total pressure within the range from about 1500 psig to about 2500 psig and a hydrogen partial pressure within the range from about 1200 psig to about 1600 psig. Gaseous products and any unconsumed hydrogen may be withdrawn from the conversion zone through line 129. The conversion products, except any that may be withdrawn through line 129 and any unreacted feed (and spent solvent, when a solvent is employed) will be withdrawn from the conversion zone 127 through line 130.

The effluent from conversion stage or zone 127 withdrawn through line 130 is then fed to a suitable separator 131. The separator may consist of any suitable means for separating the effluent into its various fractions such as a gaseous fraction, a liquid fraction, and a bottoms fraction which, when a solid carbonaceous material is converted, will be normally solid. Suitable separation devices include, but are not necessarily limited to, knock-out pots, which may be used alone or in combination with filters, centrifuges, distillation apparatus and the like. In a preferred embodiment, and particularly when a solid carbonaceous material is converted, the separation means will be a distillation column comprising an atmospheric and vacuum fractionation column. When such a distillation apparatus is employed, a normally gaseous product may be withdrawn overhead through line 132. Similarly, a bottoms product, which may be normally solid and include unconverted feed, catalyst and ash, may be withdrawn through line 133. The normally liquid product may then be separated into fractions having any desired boiling range or ranges. For example, a relatively light product boiling, generally, within the naphtha range may be withdrawn through line 134. A heavier boiling fraction, for example, a fraction having an initial boiling point within the range from about 350° to about 650° F. and a final boiling point within the range from about 700° to about 1100° F. may be withdrawn through line 135 and a still higher boiling fraction, for example, a fraction having an initial boiling point within the range from about 650° to about 800° F. and a final boiling point within the range from about 800° to about 100° F. may be withdrawn through line 136.

In a preferred embodiment and when a solid carbonaceous material is converted, particularly coal, lignite, peat and the like, at least a portion of the material having an initial boiling point within the range from about 350° to about 650° F. and a final boiling point within the range from about 700° to about 1100° F. will be recycled and used as a solvent. The recycle may be accomplished through lines 135–135 where the recycle solvent would be introduced into mixing vessel 113 through line 114. When recycled solvent is not, however, used or when the amount of recycle solvent available is not sufficient, extraneous solvent may be introduced into line 114 through line 137. In those cases where the amount of solvent boiling range material is in excess of needs, the excess may be withdrawn through line 138.

While not illustrated, and as indicated, supra, when a petroleum residual is converted in accordance with the process of this invention and when a solvent is employed, the higher boiling fraction withdrawn through line 136 would, normally, be recycled and used as recycle solvent.

Any stream ultimately withdrawn from the separator may be used directly for many purposes as a final product or any or all of the streams may be further upgraded to yield products of enhanced value. For example, the gaseous stream withdrawn in line 129 and overhead through line 132 may be combined, scrubbed to separate pollutants and other non-combustible materials and treated to separate molecular hydrogen so as to yield a pipeline quality gas. Similarly, the lighter boiling fraction withdrawn through line 134, which boils in the motor gasoline range, may be further upgraded to yield a high quality gasoline. A fraction boiling in the middle distillate range may be further treated to yield a middle distillate fuel oil and, in some cases, to yield a diesel fuel. The heaviest boiling fraction withdrawn through line 136 may also be further treated to yield a satisfactory vacuum gas oil which may also be used as a fuel. The bottoms product withdrawn through line 133 may be burned directly to recover its fuel value or the same may be discarded directly, especially in those cases where the carbon content is too low to support combustion. As indicated previously, all or a part of the catalyst species may be separated prior to discarding. Moreover, a portion of this bottoms stream could be recycled to the conversion zone 127 to increase the concentration of catalyst therein, thereby increasing the total conversion of carbonaceous material during the conversion step and reducing the amount of catalyst precursor added initially.

Having thus broadly described the present invention and a preferred and most preferred embodiment thereof, it is believed that the same will become even more apparent by reference to the following examples. It will be appreciated, however, that the examples are presented solely for purposes of illustration and should not be construed as limiting the invention.

EXAMPLE 1

In this example, cis-dioxobis(N,N-diethyldithiocarbamato)molybdenum(VI) was prepared by adding hydrochloric acid (2N) dropwise to a cold solution containing 14 g. of sodium N,N-diethyldithiocarbamate trihydrate, 15 g. of sodium molybdate dihydrate, and 20 g. of sodium acetate until the pH reached 5.5. The resulting yellow precipitate was collected by filtration, washed thoroughly, and dried under vacuum. The yield of product was quantitative.

EXAMPLE 2

In this example, cis-dioxobis(N,N-di-n-butyldithiocarbamatolmolbydenum(VI) was prepared by first preparing a solution of sodium di-n-butyldithiocarbamate by adding 33 g. (0.55 mole) of carbon disulfide to an ice cold, stirred suspension of 20 g. (0.55 mole) of NaOH and 65.5 g. (0.5 mole) of di-n-butylamine in 700 mL of water and stirring for 45 minutes. The resulting solution was filtered to remove suspended impurities. A solution of 60 g. of sodium molybdate in 500 mL of water was then added. The mixture was acidified with 400 mL of dilute hydrochloric acid (133 mL of concentrated hydrochloric acid in 400 mL of water). The mixture containing the purple mass was stirred for 30 more minutes, 350 mL of toluene was added and the mixture was stirred for an additional 10 minutes. The mixture was then transferred to a separatory funnel and the bottom layer discarded. The remaining toluene solution was washed with 250 mL of water and then concentrated to dryness on a rotary evaporator. Heptane (300 mL) was then added and the mixture was allowed to stand overnight. The resulting solid was collected by filtration and dried in a vacuum desiccator overnight. The product was recrystallized from toluene. Analysis calculated for $C_{18}H_{36}N_2O_2S_4Mo$: Mo, 17.9%; Found 17.95%.

EXAMPLE 3

In this example, Tris(N,N-di-n-butyldithiocarbamato) cobalt(III) was prepared by adding 12.9 grams of n-butylamine and 7.6 g. of $CS_2$ in small portions to an ice-cold stirred solution of NaOH in 50 mL of water. A solution of 12.4 g. of cobalt acetate tetrahydrate in 200 mL of water was then added to the above solution. The resulting green solid was recrystallized from acetone-water followed by toluene-heptane. The yield of the product was 18.8 g. (93% conversion).

EXAMPLE 4

In this example, Tris(N,N-dimethyldithiocarbamato)-cobalt (III) was prepared by adding an aqueous solution of 12.5 g. of cobalt acetatetetrahydrate to a water solution of the sodium salt of N,N-dimethyldithiocarbamic acid. The sodium salt was prepared by mixing a solution of 40 g. of NaOH in 200 mL of water with 112.5 g. of 40% dimethylamine solution in water and 96 g. of $CS_2$. The product was isolated in 75% yield as a green powder.

EXAMPLE 5

In this example, Bis(N,N-di-n-butyldithiocarbamato)-nickel (II) was prepared by adding an aqueous of 62.25 g. of nickel acetate tetrahydrate to an ice-cold aqueous solution containing 20 g. NaOH, 38 g.$CS_2$, and 64.59. di-n-butylamine. The resulting solid was collected by filtration, washed well with water and dried in a vacuum desiccator. The solid was recrystallized from acetone-heptane. The yield of green crystalline material was 78%.

EXAMPLE 6

In this example, Bis(N,N-dimethyldithiocarbamato)-nickel(II) was similarly prepared in 93% yield from 40 g. of NaOH, 45 g. dimethylamine, 76 g. of $CS_2$ and 125 g. of nickel acetate tetrahydrate.

EXAMPLE 7

In this example, Tris(N,N-di-n-propyldithiocarbamato)iron (III) was prepared from 27 g. of $FeCl_3$,6-$H_2O$ and sodium N,N-di-n-propyldithiocarbamate prepared from 30.3 g. of di-n-propylamine, 12 g. of NaOH and 23 g. of $CS_2$. The material was obtained as black, shiny crystals in 81% yield.

EXAMPLE 8

In this example, Tris(N,N-di-n-butyldithiocarbamato)iron(III) was prepared in 84% yield from 68.1 g. of sodium N,N-di-n-buyldithiocarbamate and 27 g. of $FeCl_3.6H_2O$ by standard procedure given in previous examples. Analysis: Found, Fe, 8.0%; Calculated, 8.4%.

EXAMPLE 9

In this example, the catalyst of Example 2 was used as a hydroconversion catalyst for liquefying Wyodak coal. 0.017 grams of the catalyst were combined with 3 grams of coal and 4.8 grams of a hydrogen donor solvent obtained from a coal liquefaction recycle stream and containing 400°-700° F. material, and having about 1.2 wt. % donatable hydrogen. The mixture was heated in the presence of hydrogen at 840° F. in a standard tubing bomb experiment. The initial pressure was 2400 psig and the conversion reaction was permitted to continue for 60 minutes. After this time, the reaction vessel was cooled the and the products extracted with cyclohexane to determine conversion. The total conversion of coal (dry basis) was 56.2%.

EXAMPLE 10

In this example, the catalyst of Example 1 was used as a hydroconversion catalyst for liquefying Wyodak coal. 0.015 g. of the catalyst were used and the same procedures as Example 9 were followed. The total conversion of coal (dry basis) was 55.4%.

EXAMPLE 11

In this example, the catalyst of Example 5 was used as a hydroconversion catalyst for liquefying Wyodak coal. 0.024 g. of the catalyst were used and the same procedures as Example 9 were followed. The total conversion of coal (dry basis) was 48.9%.

EXAMPLE 12

In this example, the catalyst of Example 3 was used as a hydroconversation catalyst for liquefying Wyodak coal. 0.024 g. of catalyst were used and the same procedures as Example 9 were followed. The total conversion of coal (dry basis) was 49.5%.

EXAMPLE 13

In this example, and for purposes of comparison, 3 g. of Wyodak coal were combined with a solvent identical to that used in Example 9 at a solvent/coal ratio of 1.6:1 and subjected to conversion in the presence of hydrogen at a total pressure of 2400 psig and a temperature of 840° F. for 60 minutes. No catalyst was used in this example. After 60 minutes, the reaction was quenched and the products separated to determine conversion. In this example, the total conversion of coal (DAF) was 40.1 wt. %.

EXAMPLE 14

In this example, the catalyst of Example 8 was used as a hydroconversion catalyst for liquefying Wyodak coal. 0.05 g. of catalyst were used and the same procedures as Example 9 were followed. The total conversion of coal (dry basis) was 46.5%.

EXAMPLE 15

In this example, different catalysts were tested in 300 mL, stainless steel autoclaves equipped with magnetically driven stirrers, 40 g. of coal were used in each experiment, along with 64 g. of the previously described solvent. Other reaction conditions were the same as described for the tubing bomb experiments. Conversions and liquid yields were determined by atmospheric-vacuum distillation of the products. The data are tabulated in the following table:

Autoclave Results
LIQUEFACTION, WYODAK COAL:
2500 PSIG (CONSTANT) $H_2$, 840° F., 60 Min.
Solvent DH 1.2 WT. %; Solvent: Coal 1.6

| Catalyst | PPM Metal | Conversion Wt. % Dry Coal | Increase In Convers. | Liquid Yield Wt. % Dry Coal | Liquid Yield Increase |
|---|---|---|---|---|---|
| — | 0 | 39.7 | Base | 10.6 | Base |
| DiMeCoDTC* Example 4 | 1000 | 55.0 | +16.0 | 29.3 | 18.7 |
| DiMeNiDTC* Example 6 | 1000 | 57.0 | +18.0 | 34.5 | 23.9 |
| DiPrFeDTC* Example 7 | 14,000 | 60.3 | +20.3 | 41.8 | 31.2 |

-continued

Autoclave Results
LIQUEFACTION, WYODAK COAL:
2500 PSIG (CONSTANT) $H_2$, 840° F., 60 Min.
Solvent DH 1.2 WT. %; Solvent: Coal 1.6

| Catalyst | PPM Metal | Conversion Wt. % Dry Coal | Increase In Convers. | Liquid Yield Wt. % Dry Coal | Liquid Yield Increase |
|---|---|---|---|---|---|
| DiPrFeDTC* Example 7 | 2800 | 49.8 | +10.1 | 24.4 | 13.8 |

*DTC = dithiocarbamate

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described the invention, what is claimed is:

1. A process for hydroconverting a carbonaceous material selected from the group consisting of coal, lignite and peat; comprising:
   (a) forming a mixture of a carbonaceous material selected from the group consisting of coal, lignite and peat and mixtures thereof and a catalyst precursor consisting essentially of a dihydrocarbyl substituted dithiocarbomate of a metal selected from any one of Groups VI-A and VIII-A or a mixture thereof;
   (b) subjecting this mixture to hydroconversion at a temperature within the range from about 500° to about 900° F. at a total pressure within the range from about 500 to about 7000 psig and with a hydrogen partial pressure within the range from about 400 to about 5000 psig; and
   (c) recovering a lower molecular weight product from the conversion effluent.

2. A process of claim 1 wherein the hydroconversion is accomplished at a temperature within the range from about 700° to about 870° F. at a total pressure within the range from about 800 to about 3000 psig and within a hydrogen partial pressure within the range from about 1000 to about 1800 psig.

3. A process of claim 1 wherein the hydroconversion is accomplished at a temperature within the range from about 750° to about 860° F. at a total pressure within the range from about 1500 to about 2500 psig and with a hydrogen partial pressure within the range from about 1200 to about 1600 psig.

4. A process of claim 1 wherein a sufficient amount of dihydrocarbyl substituted dithiocarbamate of a metal or mixture thereof is added to said mixture to provide from about 10 to about 10,000 ppm metal by weight based on carbonaceous material during the hydroconversion of step (b).

5. A process of claim 1 wherein a sufficient amount of dihydrocarbyl substituted dithiocarbamate of a metal or mixture thereof is added to said mixture to provide from about 50 to about 2000 ppm metal by weight based on carbonaceous material during the hydroconversion of step (b).

6. A process of claim 1 wherein a sufficient amount of dihydrocarbyl substituted dithiocarbamate of a metal or mixture thereof is added to said mixture to provide from about 100 to about 1000 ppm metal by weight based on carbonaceous material during the hydroconversion of step (b).

7. A process of claims 4, 5 or 6 wherein the amount of dihydrocarbyl substituted dithiocarbamate of a metal or mixture thereof added to said mixture is reduced by recycling at least a portion of the bottoms product.

8. A process of claim 1 wherein said metal is selected from Group VI-A of the Periodic Table.

9. A process of claim 1 wherein said metal is molybdenum.

10. A process of claim 1 wherein the dihydrocarbyl substituted dithiocarbamate of a metal has the general formula:

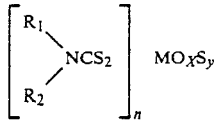

wherein:

$R_1$ and $R_2$ are the same or a different $C_1$–$C_{18}$ alkyl radical; a $C_5$–$C_{18}$ cycloalkyl radical or a $C_6$–$C_{18}$ alkyl substituted cycloalkyl radical; or an aromatic or alkyl substituted aromatic radical containing 6 to 18 carbon atoms, it being understood that $R_1$ and $R_2$ may separately be any one of these hydrocarbyl radicals; and M is a metal selected from Groups, VI-A and VIII-A of the Periodic Table of Elements as copyrighted by Sargent-Welch Scientific Company, 1979, or a hydrocarbyl substituted metal from any one of the same group; and wherein:

for divalent elements X=Y=0, n=2; and for trivalent elements X=Y=0, n=3; and for tetravalent, pentavalent and hexavalent elements X=0–2 and Y=2–0 within the provision that when X=2, Y=0; when X=1, Y can be 0 or 1.

11. A process of claim 10 wherein $R_1$ and $R_2$ are the same or a different alkyl group containing from 1 to 10 carbon atoms.

12. A process for hydroconverting a carbonaceous material selected from the group consisting of coal, lignite and peat, and mixtures thereof, comprising:
   (a) forming a mixture of a carbonaceous material selected from the group consisting of coal, lignite and peat, and mixtures thereof and a catalyst precursor consisting essentially of a dihydrocarbyl substituted dithiocarbomate of a metal selected from any one of Groups VI-A and VIII-A and a suitable solvent or diluent;
   (b) subjecting the mixture from step (a) to hydroconversion conditions in the presence of molecular hydrogen at a temperature within the range from about 500° to about 900° F., a total pressure within the range from about 500 to about 7000 psig and at a hydrogen partial pressure within the range from about 400 to about 5000 psig; and
   (c) recovering a lower molecular weight product from the effluent of step (b).

13. A process of claim 12 wherein the hydroconversion is accomplished at a temperature within the range from about 750° to about 860° F. at a total pressure within the range from about 1500 to about 2500 psig and with a hydrogen partial pressure within the range from about 1200 to about 1600 psig.

14. A process of claim 12 wherein a sufficient amount of dihydrocarbyl substituted dithiocarbamate of a metal or mixture thereof is added to said mixture to provide from about 10 to about 10,000 ppm metal by weight based on carbonaceous material during the hydroconversion of step (b).

15. A process of claim 12 wherein a sufficient amount of dihydrocarbyl substituted dithiocarbamate of a metal or mixture thereof is added to said mixture to provide from about 50 to about 2000 ppm metal by weight based on carbonaceous material during the hydroconversion of step (b).

16. A process of claim 12 wherein a sufficient amount of dihydrocarbyl substituted dithiocarbamate of a metal or mixture thereof is added to said mixture to provide from about 100 to about 1000 ppm metal by weight based on carbonaceous material during the hydroconversion of step (b).

17. A process of claims 14, 15 or 16 wherein the amount of dihydrocarbyl substituted dithiocarbamate of a metal or mixture thereof is added to said mixture is reduced by recycling at least a portion of the bottoms product.

18. A process of claim 12 wherein the metal is selected from Group VI-A of the Periodic Table.

19. A process of claim 18 wherein the metal is molybdenum.

20. A process of claim 12 wherein the dihydrocarbyl substituted dithiocarbamate of a metal has the general formula:

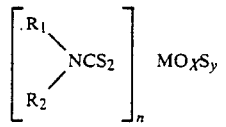

wherein:

$R_1$ and $R_2$ are the same or a different $C_1$–$C_{18}$ alkyl radical; a $C_5$–$C_8$ cycloalkyl radical or a $C_6$–$C_{18}$ alkyl substitute cycloalkyl radical; or an aromatic or alkyl substituted aromatic radical contains 6 to 18 carbon atoms, it being understood that $R_1$ and $R_2$ may separately be any one of these hydrocarbyl radicals; and M is a metal selected from Groups, VI-A and VII-A of the Periodic Table of Elements as copyrighted by Sargent-Welch Scientific Company, 1979, or a hydrocarbyl substituted metal from any one of the same group; and wherein:

for divalent elements X=Y=0, n=2; and for trivalent elements X=Y=0, n=3; and for tetravalent, pentavalent and hexavalent elements X=0–2 and Y=2–0 within the provision that when X=2, Y=0; when X=1, Y can be 0 or 1.

21. A process of claim 20 wherein $R_1$ and $R_2$ are the same or a different alkyl group containing from 1 to 10 carbon atoms.

22. A process of claim 12 wherein the hydroconversion is accomplished at a temperature within the range from about 700° to about 870° F. at a total pressure within the range from about 800 to about 3000 psig and with a hydrogen partial pressure within the range from about 1000 to about 1800 psig.

* * * * *